US005131419A

United States Patent [19]

Roberts

[11] Patent Number: 5,131,419

[45] Date of Patent: Jul. 21, 1992

[54] MULTI-FUNCTION WAREWASHING MACHINE

[76] Inventor: Donald E. Roberts, 4250 Saratoga Ave. #217, Downers Grove, Ill. 60515

[21] Appl. No.: 526,384

[22] Filed: May 21, 1990

[51] Int. Cl.[5] ..... A47L 15/16; A47L 15/22; A47L 15/32

[52] U.S. Cl. ..... 134/50; 134/57 D; 134/98; 134/113; 134/138; 134/153; 134/200

[58] Field of Search ..... 134/46, 47, 50, 54, 134/55, 56 D, 57 D, 113, 138, 139, 58 D, 98, 153, 199, 200

[56] References Cited

U.S. PATENT DOCUMENTS

| | | | |
|---|---|---|---|
| 2,918,927 | 12/1959 | Clearman | 134/98 X |
| 3,760,825 | 9/1973 | Barnun | 134/56 D |
| 3,858,595 | 1/1975 | Schultz et al. | 134/57 D X |
| 4,233,083 | 11/1980 | Roberts | 134/25.2 |
| 4,456,022 | 6/1984 | Roberts | 134/153 X |

FOREIGN PATENT DOCUMENTS

| | | | |
|---|---|---|---|
| 2211310 | 9/1977 | Fed. Rep. of Germany | 134/56 D |
| 2617846 | 11/1977 | Fed. Rep. of Germany | 134/56 D |
| 821438 | 8/1937 | France | 134/138 |
| 2505643 | 11/1982 | France | 134/58 D |

*Primary Examiner*—Philip R. Coe

*Attorney, Agent, or Firm*—Trexler, Bushnell, Giangiorgi & Blackstone, Ltd.

[57] ABSTRACT

A multi-function warewashing machine which automatically functions in a plurality of operating modes, including a conventional dishwashing mode and specialized washing modes for flatware and pots and pans, the operating mode being indicated by ware racks each of which bears an indicator in the form of an anomaly or signalling device which uniquely predetermines the optimum spray patterns and timing cycles for a particular type of ware contained in the rack, the warewashing machine including a sensor for detecting the indicator and a control circuit which responds to the sensor to actuate various controllable devices in combination to produce specific spray patterns and wash and rinse cycle times which are best suited for cleansing a particular ware.

29 Claims, 13 Drawing Sheets

DISHWASH CYCLE

DISH RINSE CYCLE

FLATWARE WASH CYCLE

SECOND FLATWARE RINSE CYCLE

POT & PAN CYCLE
DELAY WASH PERIOD

POT & PAN WASH CYCLE

POT & PAN RINSE CYCLE

MULTI-FUNCTION WAREWASHING MACHINE

BACKGROUND OF THE INVENTION

This invention relates to equipment for use in the food service industry, and more particularly to apparatus for washing utensils used in the preparation and serving of foods, beverages, and the like.

The vast majority of food serving operations such as restaurants, hospitals, school cafeterias and the like, use a general purpose, single tank, stationary rack commercial dishwashing machine to cleanse food service utensils. Although commercially available dishwashing machines provide acceptable cleansing of plates, cups, drinking glasses and the like, it is well known that optimum washing and drying of flatware, and pots and pans cannot be realized with a conventional dishwashing machine. One reason for this is that the moderate spray pressure which is used in conventional dishwashing machines to minimize breakage of breakable dishes and drinking glasses does not provide sufficient hydraulic force for adequately cleansing flatware and pots and pans. Another reason is that the locations of the wash-spray and rise spray units and the conical spray patterns provided in dishwashing machines are not optimum for flatware washing or pot and pan washing because different spray treatments are required.

Specifically, it is common practice in the food service industry to insert knives, forks and spoons in the handle-down orientation in tall, perforated washing cylinders which are loaded into a dishwashing machine for cleansing the flatware. The conical spray pattern at moderate spray pressure from conventional upper and lower dishwasher spray units is generally ineffective because the flatware items cup, nest or otherwise shield one another from the dishwasher sprays. This is particularly true because concave forks and spoons held in an essentially vertical position have their concave surfaces by and large shielded from vertically oriented sprays. Moreover, even with high temperature rinse type machines, shielded flatware surfaces will not be fully exposed to heated rinse water and consequently will not attain the "plate temperature" necessary for sanitizing and post-rinsing air drying, and may harbor the residual water droplets that cause unsightly, and unsanitary spots or streaks.

Prior attempts to address these problems include specialized washing machines such as those shown in my U.S. Pat. No. 4,233,083 entitled Presorted Flatware Washing Method and Apparatus and in my U.S. Pat. No. 4,456,022 entitled Flatware Washing Machine. However, the apparatus disclosed in my earlier patents provide improvements in the cleaning of flatware. Although my patented flatware washing machine have proven to resolve problems related to cleaning of flatware, these machines are applicable to only those high volume food service operations that can justify a separate warewashing machine dedicated to the washing of flatware.

The cleansing of pots and pans used in the food service industry is characterized by other problems not present in the cleansing of dish ware and flatware. For example, pots and pans are generally large and bulky utensils, and interior surfaces of the pots and pans that have become caked with food residue as the result of cooking operations may be shielded from or remote from the wash nozzles. Moreover, the moderate spray pressure and conical shaped spray patterns provided by dishwasher wash and rinse nozzles is incapable of removing hardened, baked-on food residue and the like. A further problem is that the wash and rinse cycle times provided for dish ware and flatware, for example, are too short to allow adequate cleansing of pots and pans.

Although a number of manufacturers offer warewashing machines designed specifically for flatware and other warewashing machines designed specifically for pots and pans, and the like, the high cost of such machines makes them available only to the minority of food service industry operations which are large enough to justify the separate costly machines.

Therefore, it would be desirable to have a compact multiple purpose warewashing machine having the capability to function as a dishwasher, flatware washer, or pot and pan washer.

SUMMARY OF THE INVENTION

It is an object of the present invention to provide an improved warewashing machine.

Another object of the present invention is to provide a multi-function warewashing machine having a plurality of operating modes each providing different spray patterns and different spray impact forces.

Yet another object of the present invention is to provide a multi-function warewashing machine wherein differing spray patterns and/or timing cycles are provided automatically as a function of the type of utensil being cleansed and with minimum operator intervention.

A further object of the present invention is to provide a multi-function warewashing machine including a sensor constructed and arranged to sense indicators on utensil racks positioned within the machine and to cause selective implementation of different machine operating modes as a function of the sensing of a specific indication Another object of the invention is to provide a multi-function warewashing machine which is characterized by low cost and ease in operation.

Another object of the present invention is to provide a rack for use in warewashing machines which rack embodies an indicator which automatically predetermines the optimum elements of processing for the type of utensils contained in the rack.

These and other objects are achieved by the present invention which has provided a multi-function warewashing machine.

The present invention provides a warewashing machine for cleansing wares of different types, comprising means defining a warewashing chamber, spray producing means selectively operable in a plurality of modes to produce a plurality of wash spray patterns and a plurality of rinse spray patterns in the warewashing chamber, and control means for controlling the operation of the spray means and including select means for selecting different wash spray patterns and different rinse spray patterns as a function of the type of ware to be cleansed.

In accordance with another aspect of the invention, there is provided a system for cleansing different types of wares, the combination comprising: a warewashing machine including means defining a warewashing chamber, spray producing means selectively operable in a plurality of operating modes to produce a plurality of wash and rinse spray patterns in the warewashing chamber, sensing means and control means responsive to the sensing means for controlling the operation of the spray means, and a plurality of ware receiving racks adapted to be inserted into the warewashing chamber for introducing wares to be cleansed into the warewashing chamber, different ones of the racks receiving different types of wares, at least one of the racks including indicating means for indicating an operating mode to be selected for the spray means, the sensing means responding to the indicating means when the one rack is inserted into the warewashing chamber to cause the control means to configure the spray means for operation in the operating mode indicated by the indicating means whereby wash and rinse spray patterns produced are optimum for cleansing wares contained in the one rack.

In still another aspect of the invention, there is provided a rack for use with a warewashing machine which is selectively operable in a plurality of operating modes, each mode being characterized by different wash and rinse spray patterns, the warewashing machine having sensing means and control means responsive to the sensing means for configuring the warewashing machine for operation in a given one of its operating modes, the rack being adapted to be received in a warewashing chamber of the warewashing machine for introducing wares into the warewashing chamber for cleansing, the rack including an anomaly detectable by sensing means when the rack is in the warewashing chamber to select the operating mode for the warewashing machine.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF PREFERRED EMBODIMENTS

Figure 1:
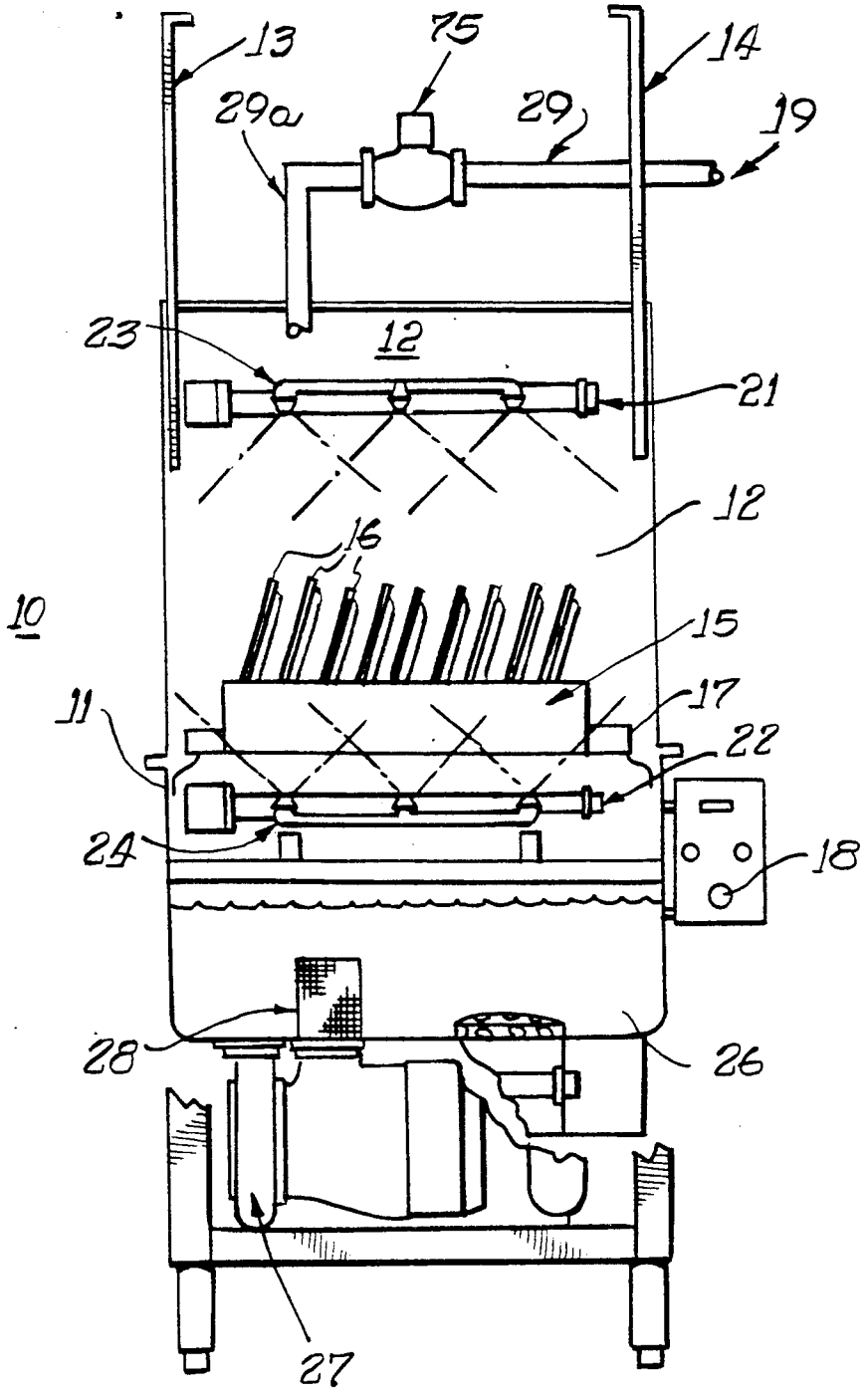
FIG. 1 PRIOR ART
FIG. 1, which is labeled prior art, is a side elevational view, partially broken away, of a single tank-stationary rack, commercial dishwasher including conventional spray units of the type used by commercial food service operations.

Referring to FIG. 1, there is illustrated a prior art conventional single tank, stationary rack, double door commercial dishwashing machine of the type used by the greater majority of food service operations. The dishwashing machine, indicated generally by reference numeral 10, includes a closed cabinet 11 defining a dishwashing chamber 12 having an entry door 13 and an exit door 14. The entry door 13 and exit door 14 are slidable vertically along suitable tracks to provide access to the dishwashing chamber 12 interior of the cabinet 11, for positioning a rack 15 containing a plurality of dishes 16 in the dishwashing chamber 12. The rack 15 is guided into the cabinet on guides 17 as is known in the art.

The dishwashing machine 10 includes an upper wash nozzle manifold 21, a lower wash nozzle manifold 22, and upper rinse nozzle manifold 23 and a lower rinse nozzle manifold 24. A recirculation pump 27 draws wash water from a wash water storage chamber 26 located in the lower portion of cabinet 11, through an inlet 28 and delivers the wash water at a boosted pressure to the upper wash nozzle manifold 21 and lower wash nozzle manifold 22 through a recirculation line (not shown). Rinse water from a rinse water inlet 19 is supplied through fluid lines 29 to the upper rinse nozzle manifold 23 and lower rinse nozzle manifold 24.

Suitable electrical circuits, mounted within the cabinet 11, control on and off cycling of the recirculation pump 27 and valves (not shown) for supplying wash and rinse water to the various nozzle manifolds 21–24 at appropriate times in the operating cycle of the dishwashing machine. A control box mounted on the outside of the cabinet 11 includes a start push button 18 for initiating a wash cycle.

As has been discussed previously, conventional dishwashing machines, such as that illustrated in FIG. 1 provide acceptable cleansing of dishes, but optimum washing of flatware, pots and pans and the like cannot be realized with conventional dishwashing machines such as dishwashing machine 10 illustrated in FIG. 1.

In accordance with the present invention, the dishwashing machine 10 is modified to provide different spray treatments for different applications and including alternative spray patterns such that the resultant apparatus, hereinafter termed a warewashing machine, is a multi-function apparatus which is operable in a plurality of modes to provide not only a dishwashing function, but also a flatware washing function and a pot and pan washing function. Moreover, the operating mode for the multi-function warewashing machine illustrated in FIGS. 2, 3 and 5 and indicated by reference numeral 30, is selected automatically in a manner to be described. Like elements for the warewashing machine 30 illustrated in FIGS. 2, 3 and 5 and of the dishwashing machine 10 illustrated in FIG. 1, have been given like reference numerals. It is pointed out that although the present invention is described with reference to an application in a single tank, stationary rack, double door warewashing machine, the principles of the invention are applicable to other types of apparatus for washing utensils, including continuous conveyor-type warewashing machines. In such machines, unracked utensils and utensil bearing racks are continuously moved through the interior of the machine, passing through wash zones and rinse zones.

Figure 2:
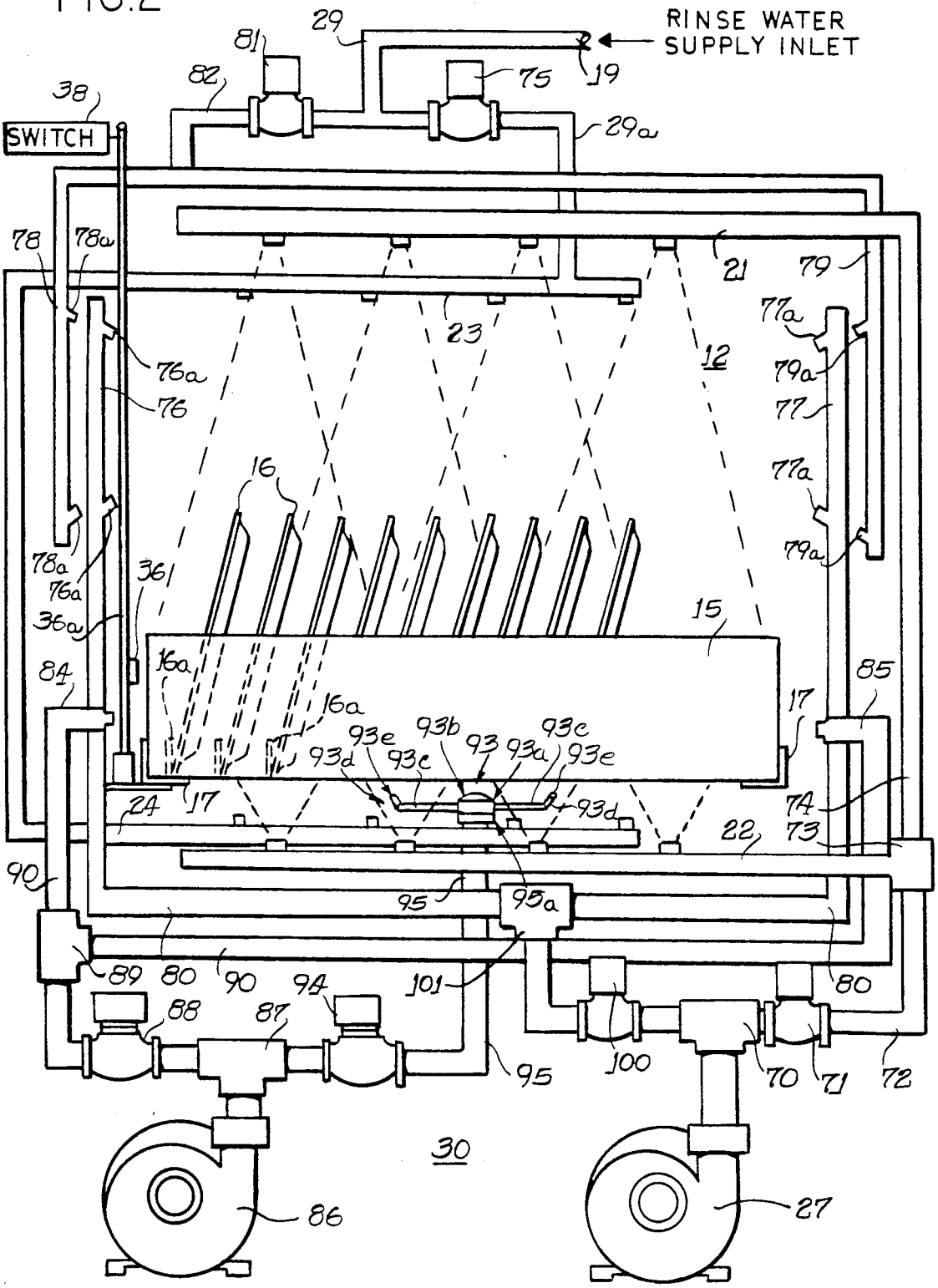
FIG. 2 is a simplified representation of a multi-function warewashing machine provided by the present invention, showing wash and rinse water flow elements, and with a dish rack positioned in the warewashing machine, configuring it for operation in a dishwashing mode.
Figure 3:
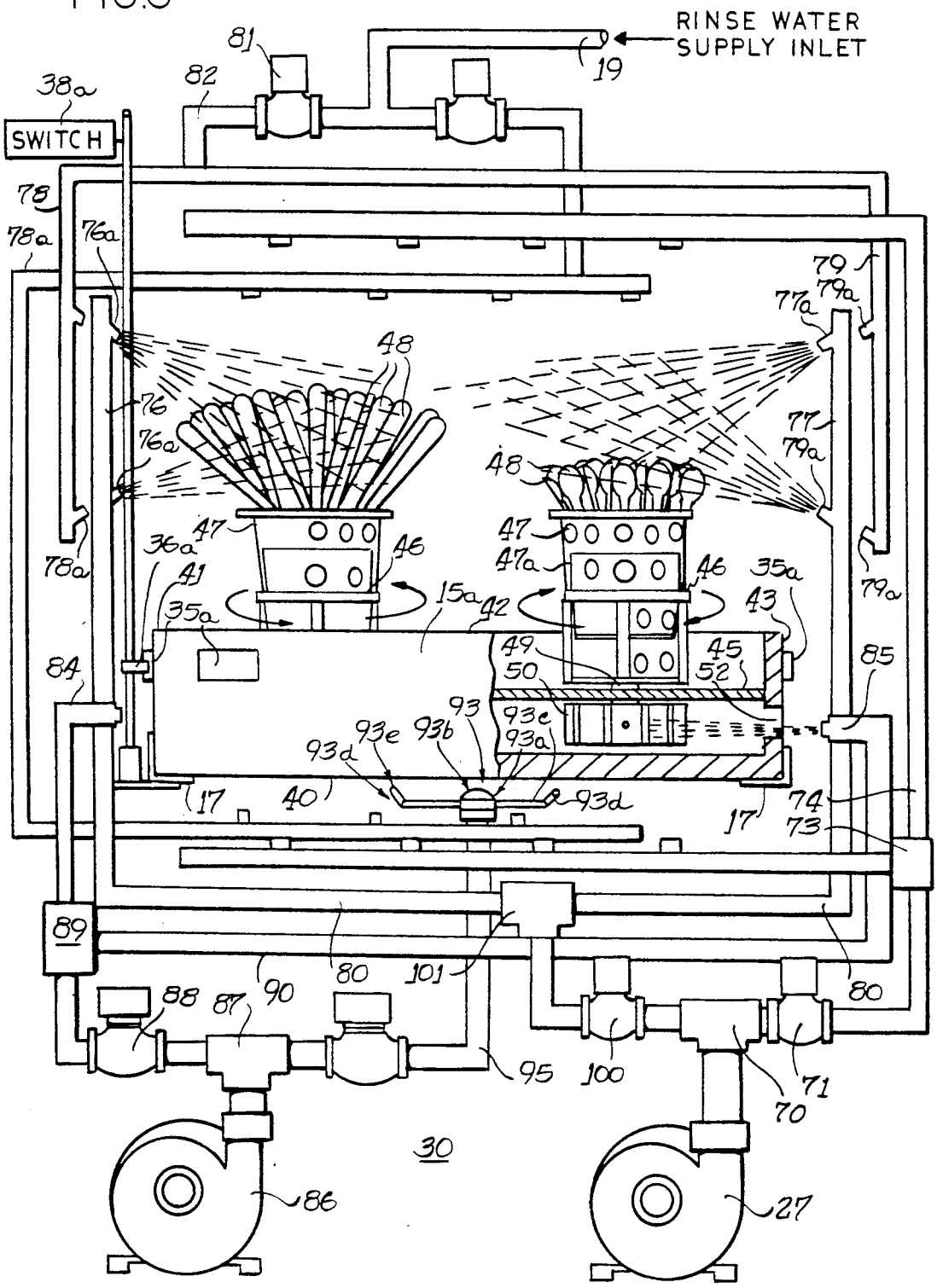
FIG. 3 is an illustration similar FIG. 2 but with a flatware rack positioned in the multi-function warewashing machine, configuring it for operation in a flatware washing mode.
Figure 5:
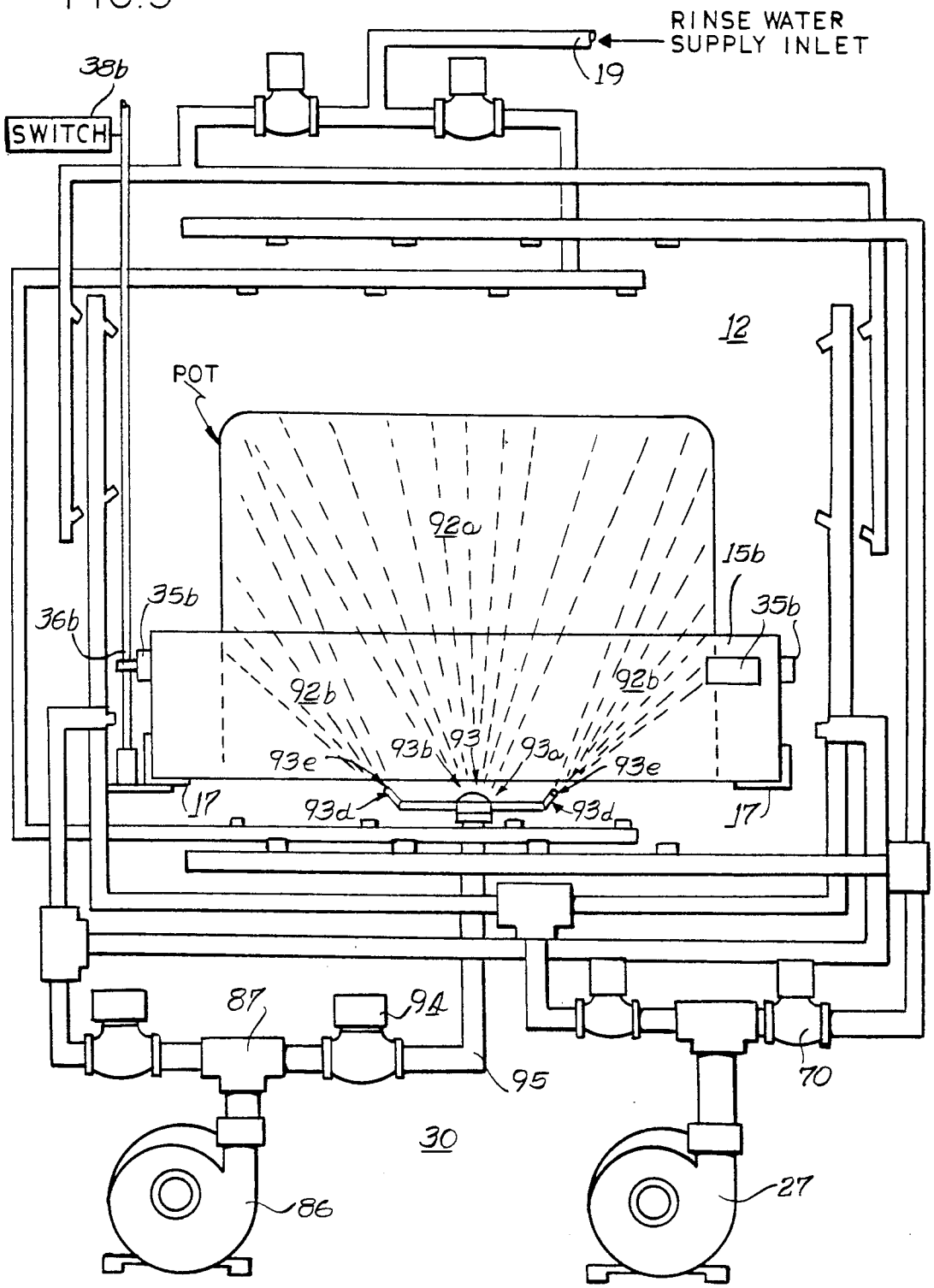
FIG. 5 is an illustration similar to FIG. 2, but with a pot and pan rack positioned in the multi-function warewashing machine, configuring it for operation in a pot and pan washing mode.
Figure 5A:
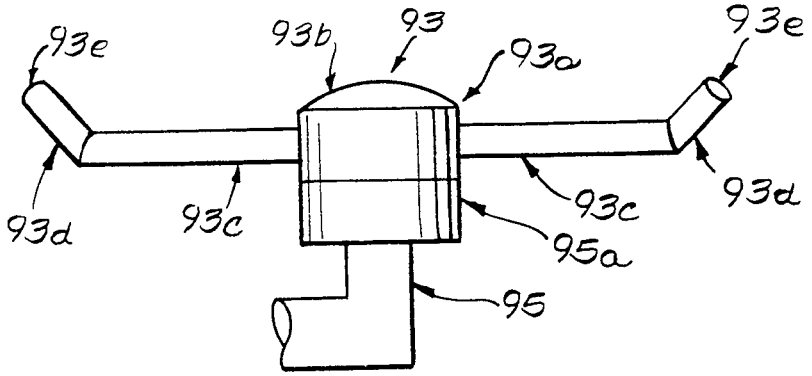
FIG. 5A is an enlarged side elevational view of the pot and pan wash nozzle.
Figure 5B:
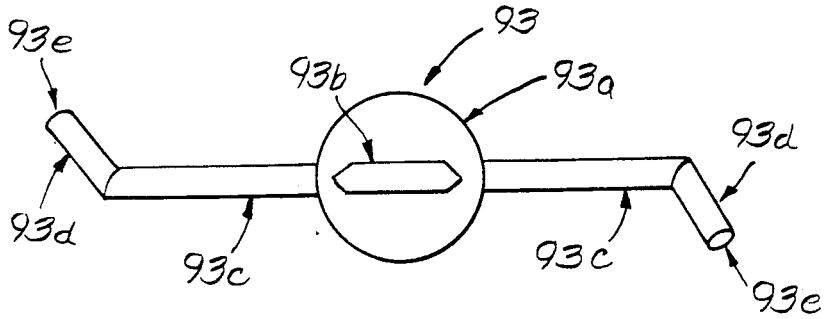
FIG. 5B is an enlarged top plan view of the pot and pan wash nozzle.

Referring to FIGS. 2, 3 and 5, there is illustrated a simplified representation of the multi-function warewashing machine 30 which functions automatically in a plurality of operating modes, which in the exemplary embodiment include a dishwashing mode (FIG. 2), a flatware washing mode (FIG. 3) and a pot and pan washing mode (FIG. 5). A different type of utensil receiving rack is used for each operating mode, the racks embodying an indicator which automatically predetermines the optimum elements of processing for the particular type of utensil that it contains. In accordance with the present invention, the particular operating mode is determined automatically by the rack that is positioned in the cleansing chamber 12, thereby minimizing operator intervention. In FIG. 2, where a dish rack 15 is shown positioned in the cleansing chamber 12, the normal dishwashing rack is selected. In FIG. 3, where a flatware rack 15*a* is shown positioned in the cleansing chamber, a specialized flatware washing mode is selected. In FIG. 5, where a pot and pan rack 15*b* is shown positioned in the cleansing chamber 12, a specialized pot and pan washing mode is selected. It is apparent that the warewashing machine may include glass washing or tray washing cycles with the addition of specific racks and other process elements, such as air blowers for tray drying and a "post-rinse" cooling cycle for glassware following a normal dishwashing cycle. To this end a rinse water mixing valve proportions some line supply hot water (typically 140°) with some line supply cold water (typically 60° to 70°).

Briefly, in the exemplary embodiment, the dish rack 15 is a conventional rack provided with appropriate dish-holding rows of fingers 16*a*, permitting a plurality of dishes 16 to be racked spaced apart from one another in a generally vertical position. For special treatment wash cycles as are required for flatware or pots and pans, the special racks, such as racks 15*a* and 15*b* are used. Each rack is customized to expose the utensil(s) it contains to the wash and rinse sprays and is provided with an indicator 35. The warewashing machine 30 includes a sensor 36 for sensing the indicators 35 on flatware racks 15*a* and pot and pan racks 15*b* and a control circuit which responds to the sensor and actuates various controllable devices in specific combinations to produce the spray patterns and the wash and rinse cycle times which are best suited for a particular application.

The indicator 35 may be in the form of an anomaly, or a signalling device. For example, the indicator 35 may be a lateral projection, an indentation in one or more sides of the rack, a vertically extending projection or recess in one or more upper edges of the rack or may be an element or device that is detectable optically, magnetically, electronically, mechanically, sonically, or in any other way.

The indicator 35 may be a rack side wall attachment or subsurface molding, which may be metallic or may be of another material differing from the rack material, or a localized area of differing rack wall surface texture.

Figure 3A:
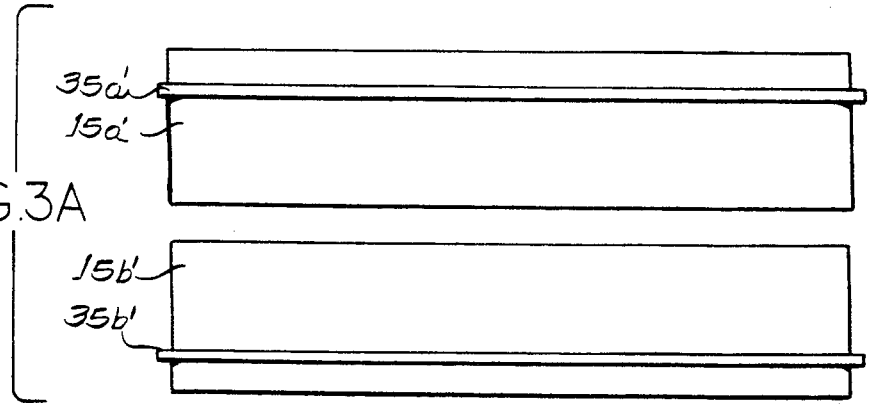
FIG. 3A is a side view of a rack illustrating an alternative embodiment for an indicator.
Figure 6:
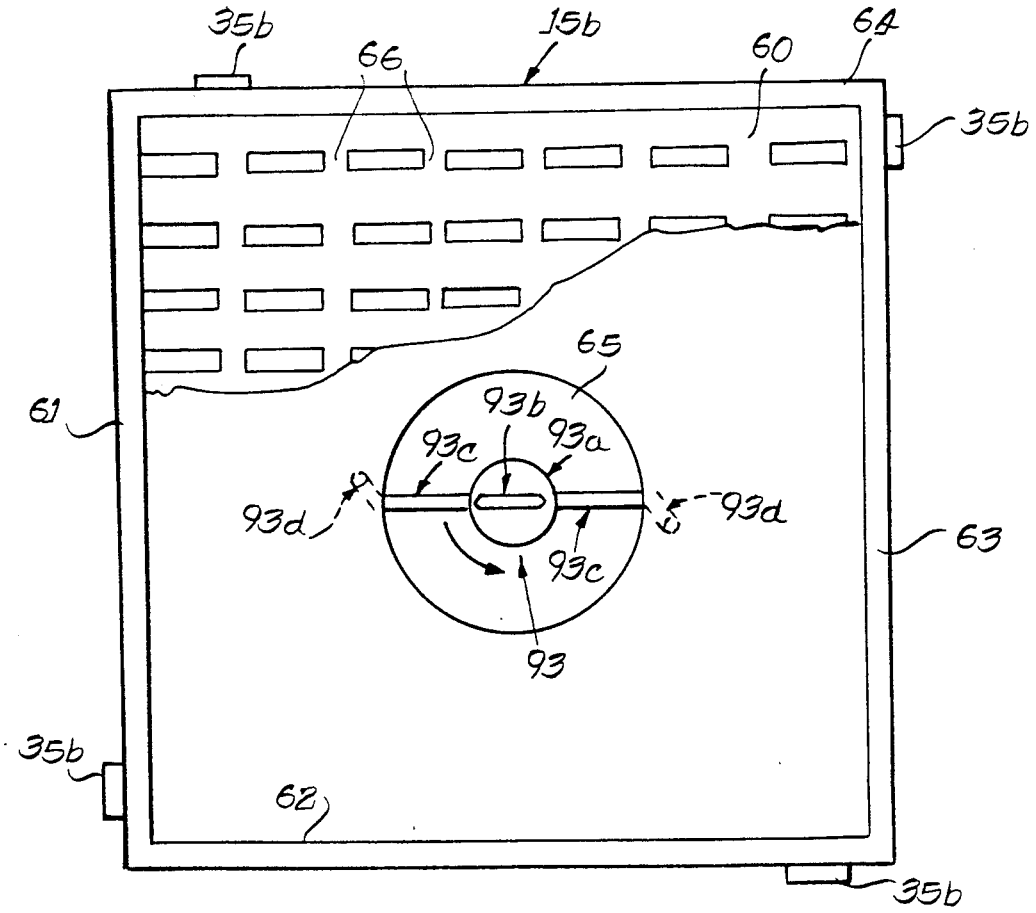
FIG. 6 is a top plan view of the pot and pan rack illustrated in FIG. 5.

In the exemplary embodiment, the indicator 35*a* for the flatware rack 15*a* is an anomaly in the form of a lateral projection, generally rectangular in shape located approximately ½ inch from the top of the rack and being approximately ¼ inch wide. The indicator 35*b* for the pot and pan rack 15*b* is a like shaped lateral projection of the same size, but spaced laterally from the position of projection 35*a* on rack 15*a* as shown in FIGS. 5 and 6. In applications for stationary rack-type machines, the indicators 35*a* and 35*b* on the two racks 15*a* and 15*b* may be located in the same horizontal plane. In conveyor-type systems wherein the racks are continuously moved through the cleansing chamber, and through wash zones and rinse zones provided therein, the indicator 35*a*' and 36*a*' extends the length of and on each side of the rack 15*a*' or 15*b*', with the indicators 35*a*' and 35*b*' being spaced vertically, for rack 15*a* relative to rack 15*b*, as shown in FIG. 3A, to provide continuous indexing of the racks 15*a*' and 15*b*' relative to the sensor as the rack moves through each zone.

An appropriate sensor 36 device or element corresponding to the indicator is incorporated into the warewashing machine 30 and located therewithin to be proximal to and/or in engagement with a utensil rack received within the washing chamber. The sensor may be operable, corresponding to the indicator used, optically, magnetically, electronically, mechanically, sonically, etc., to provide a suitable control signal to the electrical control circuit of the warewashing machine 30 to effect selection of the proper operating mode.

In the exemplary embodiment, the sensor 36 is a mechanical member, such as a lever, which is displaced or moved by the projection on the rack when the rack is inserted into the washing chamber. The mechanical member 36 operates a microswitch, one such microswitch 38*a* being provided for actuation by a lever 36*a* moved by the anomaly or projection 35*a* on the flatware rack 15*a* and a second microswitch 38*b* being provided for actuation by a lever 36*b* moved by the anomaly or projection 35*b* on the pot and pan rack 15*b*. The microswitches 38*a* and 38*b* are mounted above and outside of the washing chamber 12 and through an opening in the top of the cabinet. The mechanical members 36*a* and 36*b* are pivotally mounted to the cabinet near their upper ends and engage or are coupled to the lever arm of the associated microswitch adjacent to one of the rack guides 17.

The indicator 35 and the sensor 36 function together to cause a switch to operate and complete an electrical circuit path in the electrical control circuits of the warewashing machine 30, causing the control circuit to energize those valves and pumps required for the flatware washing cycle or pot and pan washing cycle. In the case of the dishwashing cycle, no such indicator is provided on the dish rack 15 so that a normal dishwashing cycle ensues when a dish rack 15 is inserted into the warewashing machine.

Referring to FIG. 2, the dish rack 15 for use in the dishwashing mode is a conventional square 20 inch by 20 inch rack provided with dish-holding rows of fingers 16*a* such that dishes deposited in the rack in appropriate spacings are held apart by the fingers 16*a* to expose as much of the entire surface of each dish to a spray or sprays of water administered from the spray nozzles. Each of the conventional wash and rinse nozzles provides a conical spray pattern at moderate pressure. Although a conventional rack is employed for dishwashing cycles, it is apparent that the dish rack 15 could be provided with an indicator 35 of the type provided on the flatware rack 15*a* and pot and pan rack 15*b*, but located and/or arranged to provide to the associated sensor 36 an indication different from that provided by racks 15*a* and 15*b*.

Figure 4:
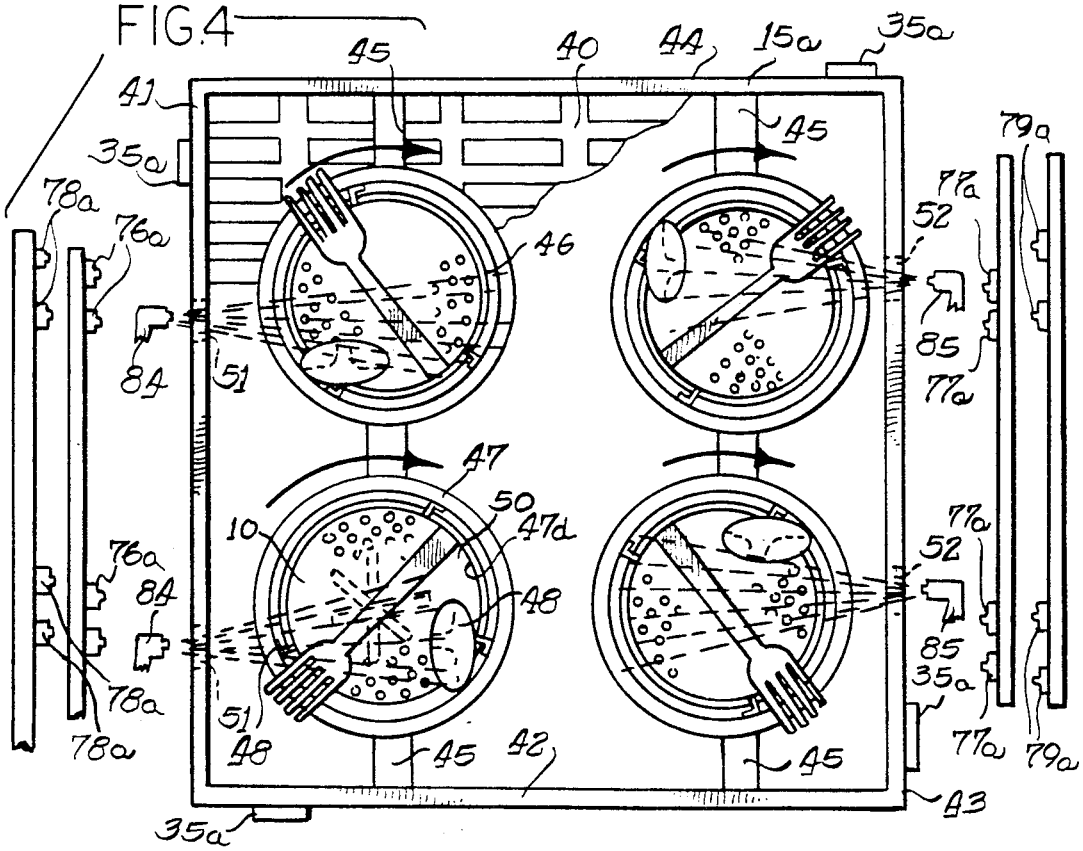
FIG. 4 is a top plan view of the flatware rack illustrated in FIG. 3.

Referring to FIGS. 3 and 4, the flatware rack 15*a* which is used in the flatware washing mode is a square 20 inch by 20 inch rack having an open webbed base 40 and four upstanding sides 41–44. The flatware rack 15*a* includes four rotatable baskets 46, each of which is adapted to receive and support a cylinder 47 that is used for holding a plurality of flatware pieces 48 in handles-down, substantially upright condition as shown. Cylinders 47 are like those disclosed in my U.S. Pat. No. 4,456,022 and include an inner cup 47*a* slidable axially with in cylinder 47 defining a lifting platform which operates as disclosed in the referenced patent to lift the flatware pieces during the washing cycle to fully expose the food-contact surfaces thereof to the washing action.

The baskets 46 are supported within the rack spaced vertically above the base 40 by pairs of rods 45, which extend between sides 41 and 43. Each of the baskets 46 has a vertically extending shaft 49 which carries an impeller 50 located beneath the support rods 45. The sides 41 and 43 of the rack 15*a* each have a pair of apertures or ports 51 and 52 which are aligned with the impellers 50.

The rack 15*a* bears an indicator 35*a* in the form of an anomaly, such as a lateral projection, which is provided at the same location at each of the four sides 41–44 of the rack 15*a*. This arrangement provides for universal indexing of the rack 15*b* so that the user need not orient the rack 15*b* in a particular orientation to effect operation in the flatware wash mode. As indicated, the indicator shown as a lateral projection 35*a*, may be an indentation in the side of the rack 15*a*, a vertically extending projection or recess in the upper edges of the rack 15*a* or may be an element or device that is detectable optically, magnetically, electronically, mechanically, or in any other way. Also, the sensor 36*a*, although illustrated as a lever which operates a microswitch 38*a*, may be any device operable optically, magnetically, electronically, mechanically, sonically, etc., to provide a suitable control signal to the electrical control circuit of the warewashing machine 30.

Referring to FIGS. 5 and 6, the pot and pan rack 15*b* which is used in the pot and pan washing mode is a square 20 inch by 20 inch rack having a base 60 and four upstanding sides 61–64. The base 60 is provided with an aperture 65 centrally located thereof. Preferably, the base 60 is formed by a plurality of cross web elements 66 as is known in the art. The rack 15*b* carries an indicator 35*b* in the form of a lateral projection which is provided at the same location of each of the four sides of the rack 15*b*, providing universal indexing for the rack 15*b*. The location for each projection 35*b* is different laterally for projections 35*a* of flatware rack 15*a* so that when a rack is positioned microswitch 38*a* is operated through lever 36*a* extending within the chamber 12, only by a projection 35*a* if the rack is a flatware rack 15*a*, and microswitch 38*b* is operated through lever 36*b* only by a projection 35*b* if the rack is a pot and pan rack 15*b*.

With reference to FIG. 2, the multi-function warewashing machine 30 includes conventional dishwashing controls and spray heads such as those employed in the conventional dishwashing machine 10 illustrated in FIG. 1. Thus, the warewashing machine 30 includes an upper wash nozzle manifold 21, a lower wash nozzle manifold 22, an upper rinse nozzle manifold 23 and a lower nozzle manifold 24 which provide wash and rinse sprays for normal dishwashing cycles. A recirculation pump 27 supplies wash water to the wash nozzle manifolds 21 and 22 through T-connector 70, through solenoid valve 71 and line 72, T-connector 73 and line 74, when valve 71 and pump 27 are energized. Rinse water is supplied through inlet 19 and line 29 through a solenoid operated valve 75 and line 29*a* to the rinse nozzle manifolds 23 and 24 when valve 75 is energized.

Referring to FIG. 3, for the purpose of providing specialized spray patterns for flatware wash operations, the warewashing machine includes a pair of vertically extending flatware wash nozzle manifolds 76 and 77, including nozzles 76*a* and 77*a*, and vertically extending flatware rinse manifolds 78 and 79, including nozzles 78*a* and 79*a*. Wash water is supplied to the flatware wash manifolds 76 and 77 by the recirculating pump 27 through T-connector 70, solenoid valve 100, T-connector 101 and lines 80 when solenoid valve 100 and pump 27 are energized. Rinse water is supplied to the flatware rinse manifolds 78 and 79 from the rinse water supply inlet 19 through line 29, solenoid valve 81 and line 82 when valve 81 is energized.

Figure 3B:
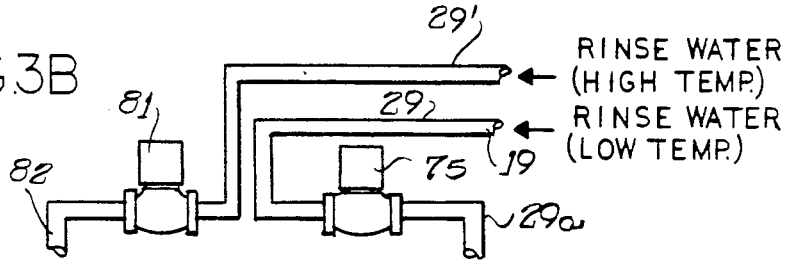
FIG. 3B illustrates an alternative valving arrangement for the rinse water supply inlet.

In the exemplary embodiment, a low temperature rinse, i.e., a rinse water temperature of 140° F. is used, and the rinse water is injected with chlorine as a sanitizing agent. In applications, such as in rinsing silverplated flatware, wherein it is undesirable to use injected chlorine, a high temperature rinse, i.e., 180° F. rinse water temperature, can be provided by the solenoid valve arrangement illustrated in FIG. 3B. The inlet of the flatware rinse nozzle valve 81 is connected to a source 29' of high temperature rinse water, whereas the inlet of the dishwasher nozzle valve 75 is connected to a source of 140° rinse water injected with chlorine. Thus, the great majority of items, china, glasses, etc., will be rinsed with low temperature rinse water and the same warewashing machine will process silverplated flatware without damage.

The flatware washing apparatus further includes two pairs of flatware rotation nozzles 84 and 85 which are located on opposite sides of the warewashing chamber 12. The nozzles 84 and 85 are aligned with ports 51 and 52 and are oriented to direct a spray inwardly through the ports 51 and 52 toward the center of the chamber 12 to impinge on the impellers 50 and rotate the baskets 46 and utensil cylinders carried thereby. Water under pressure is supplied to the flatware rotation nozzles 84 and 85 through a recirculation pump 86 which draws water from the wash water storage tank, T-connector 87, solenoid valve 88, T-connector 89 and lines 90 when pump 86 and valve 88 are energized.

The nozzles 76*a* and 77*a* provide pressurized "knife" pattern jets of wash water toward the utensil containing cylinder, and may be oriented in the manner described in my U.S. Pat. No. 4,456,022 to direct one "knife" jet towards the lip of the cylinder and one "knife" jet generally downwards towards the cylinder. The rinse nozzles 78*a* and 79*a* are similarly positioned and provide like-patterned sprays of rinse water when activated. The nozzles 76*a*, 77*a*, 78*a* and 79*a* are located outside of the perimeter of the rack 15*a*. The arrangement of the wash and rinse nozzles and the rotation imparted to the containers achieve contact of wash and rinse water with substantially all of the surfaces of the flatware pieces 48.

Referring to FIG. 5, for the purpose of providing a specialized spray pattern for pot and pan washing, the warewashing machine 30 includes an orbiting-type spray nozzle assembly 93. Spray nozzle assembly 93 includes nozzle 93*a* rotatably mounted on base 95*a* and having a slotted orifice 93*b*, and a pair of rotator arms 93*c* which extend outward radially from nozzle 93*a* at diametrically opposed positions and with their distal end portions 93*d* extending upwardly and laterally relative to the axis of the arms 93*c*, and defining oppositely directed outlet orifices 93*e*. Spray nozzle 93*a* produces a "knife" pattern jet of wash water which is directed through aperture 65 in the rack 15*b* to the inner surfaces of the pot or pan contained in rack 15*b* at and near the bottom thereof, represented by spray patterns 92*a* as shown in FIG. 5. Spray nozzles 93*e* direct spray patterns to the inner side walls of the pot or pan as shown by spray patterns 92*b*, and by virtue of the oppositely directed orifices 93*e*, cause rotation of the spray nozzle assembly 93 when wash water is supplied to the nozzle 93*e*. Wash water is supplied to the nozzle assembly 93 by recirculating pump 86 through T-connector 87, solenoid valve 94 and line 95 when the solenoid valve 94 and pump 86 are energized.

Referring to FIGS. 7–13, the warewashing machine 30 includes a control circuit 110 for appropriately cycling the action of the wash and rinse spray units during wash and rinse cycles and for providing the proper operating mode and timing cycles for dishwashing, flatware washing and pot and pan washing. The control circuit includes a power off/on switch 111, a relay 112, a relay 113, a relay 114, and a timer 120 including three cam switches 121, 122 and 123 and a timer motor 124.

The timer 120 is a conventional cam-type timer and establishes the cycle times for wash and rinse cycles. By way of illustration, the timer 120 provides a sixty second cycle time which is subdivided into a forty-five second wash cycle and a fifteen second rinse cycle. These cycle times are used for operation in all three modes. However, the control circuit 110 provides a pre-wash cycle when the warewashing machine is operating in the pot and pan wash mode. The pre-wash cycle, which is selectable to be of a duration from 0 to 180 seconds, delays the onset of the normal wash cycle.

Timer cam switch 121 controls the energization of the timer motor 124 and a door lock 115 during the wash and rinse cycles. Timer cam switch 122 controls the energization of the recirculating pump 27 and the wash cycle solenoid valves 71 and 100. Timer cam switch 123 controls the energization of the rinse cycle solenoid valves 75 and 81.

Relay 112 is a three-pole double-throw relay. Relay 112 is not energized for the dishwashing mode, thereby providing an energizing path for the wash nozzle solenoid valve 71 and rinse nozzle solenoid valve 75. Relay 112 is energized when microswitch 38*a* is operated, providing an energizing path for the flatware wash nozzle solenoid valve 100 and the flatware rinse nozzle solenoid valve 81, and an energizing path for recirculating pump 86 and flatware rotation solenoid valve 88 during the flatware wash operating mode.

Relay 113 is a single-pole, double-throw relay which is energized when microswitch 38*b* is operated, providing an energizing path for the pot and pan nozzle solenoid valve 94, and relay 114, during the pot and pan wash operating mode.

Relay 114 is a single-pole, double-throw relay which functions as a time delay device to delay the onset of a normal wash cycle for a time period adjustable, for example, from one to 180 seconds, to define the pot and pan pre-wash cycle.

Figure 7:
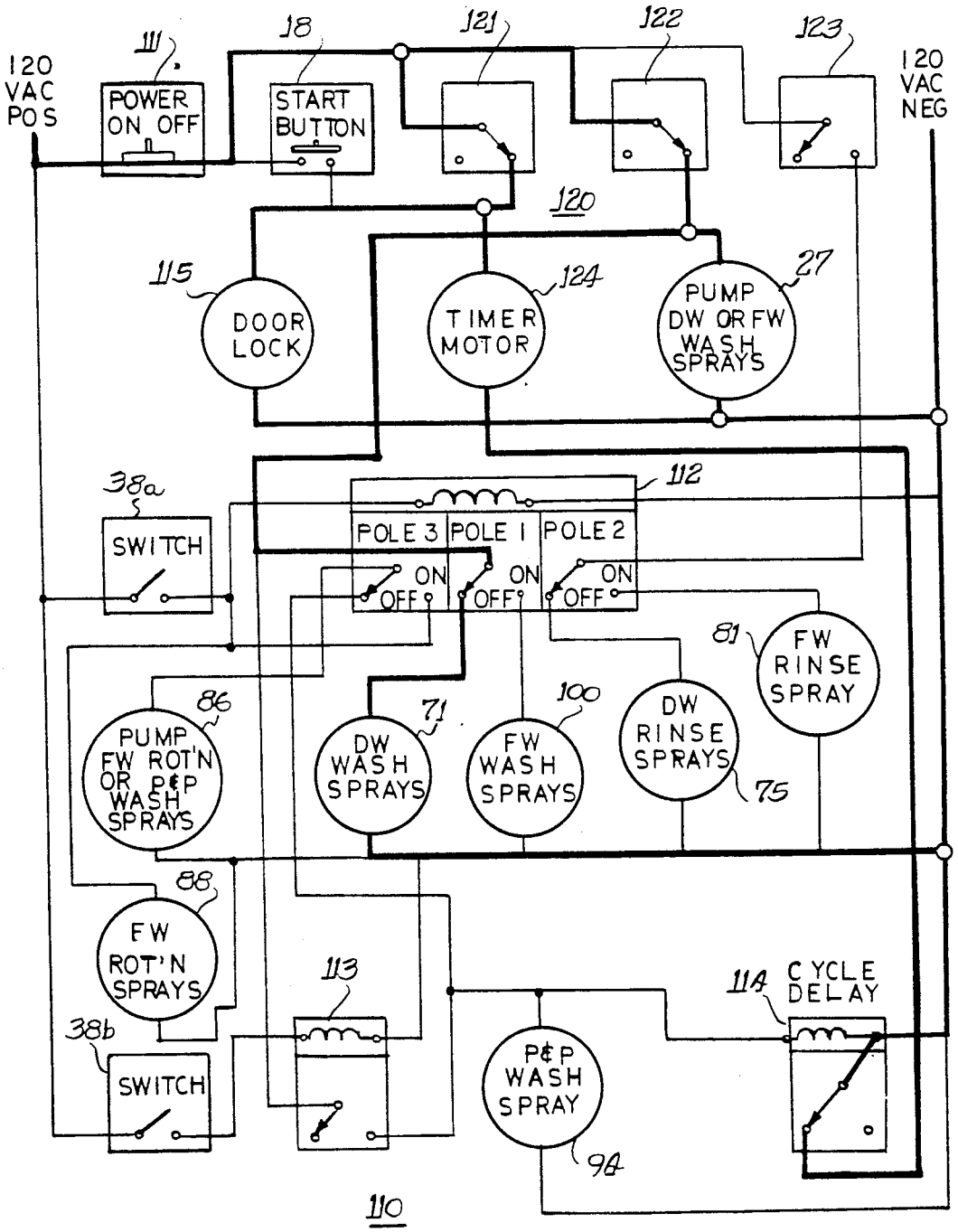
FIG. 7 is a schematic circuit diagram illustrating the electrical circuits for the warewashing machine provided by the present invention, and illustrating the circuit paths energized during the dishwashing cycle.
Figure 8:
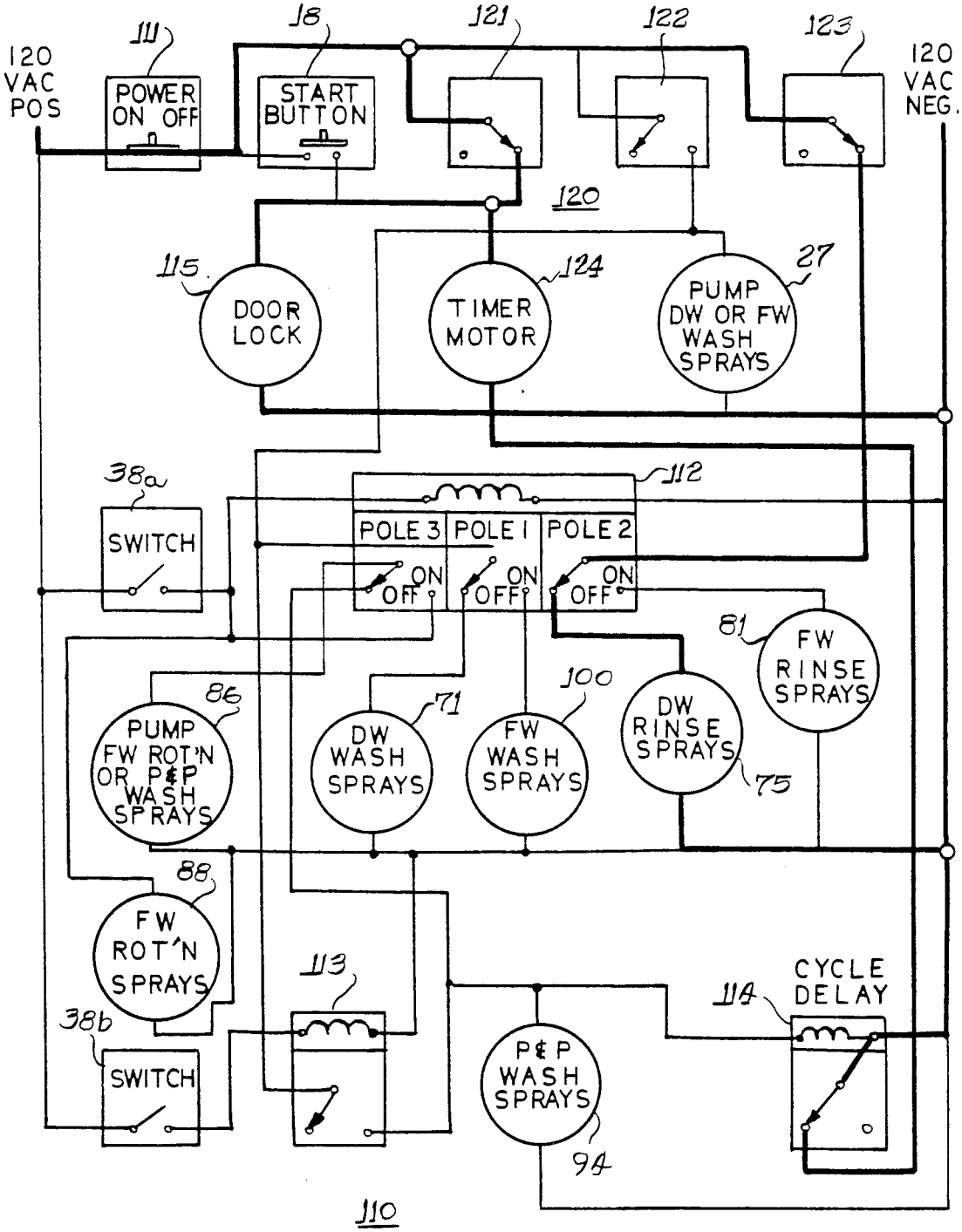
FIG. 8 is a schematic circuit diagram of the electrical circuits of the warewashing machine, illustrating the circuit paths energized during the dish rinse cycle.

Referring to FIGS. 2, 7 and 8, when a rack 15 containing a plurality of dishes 16 is positioned in the cleansing chamber 12, neither one of the microswitches 38*a* or 38*b* is operated because the dish rack 15 does not include an indicator such as projection 35*a* or 35*b*. Accordingly, a conventional dishwashing operation ensues. When the start button 18 is depressed, a dish wash cycle is initiated, the energized circuit path being represented by the heavy lines in FIG. 7. Specifically, the circulating pump 27 is energized through cam switch 122 of the timer 120 and solenoid valve 71 is energized so that wash water is supplied to the upper and lower wash nozzle manifolds 21 and 22 by the recirculating pump 27. At the end of the washing cycle, cam switch 122 deenergizes the recirculating pump 27 and solenoid valve 71 and cam switch 123 energizes solenoid valve 75 to supply rinse water to the upper and lower rinse nozzle manifolds 23 and 24 for the duration of the dish rinse cycle. The dishwashing cycle is terminated by the timer at the end of the rinse cycle.

Figure 9:
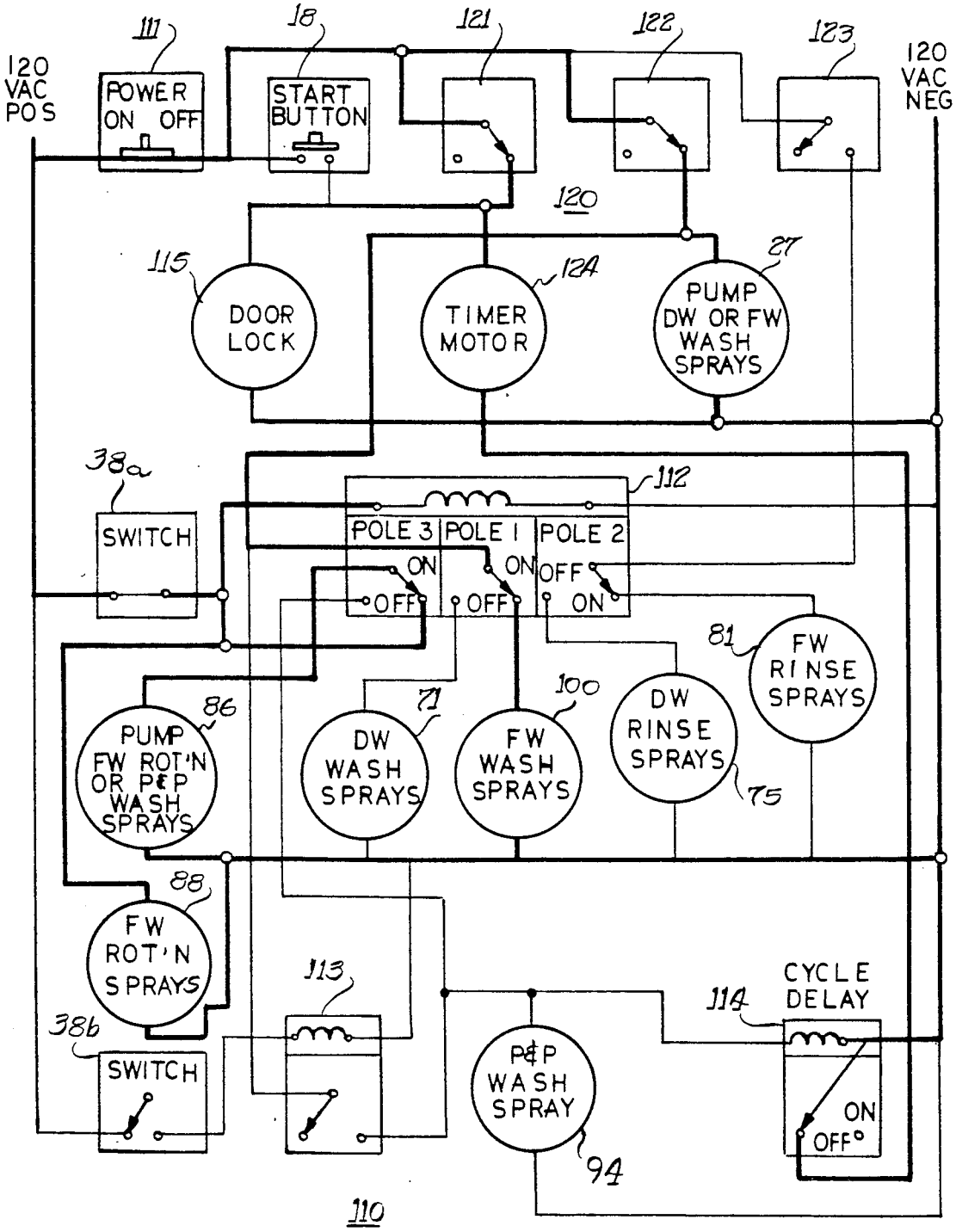
FIG. 9 is a schematic circuit diagram of the electrical circuits of the warewashing machine, illustrating the circuit paths energized during the flatware wash cycle.
Figure 10:
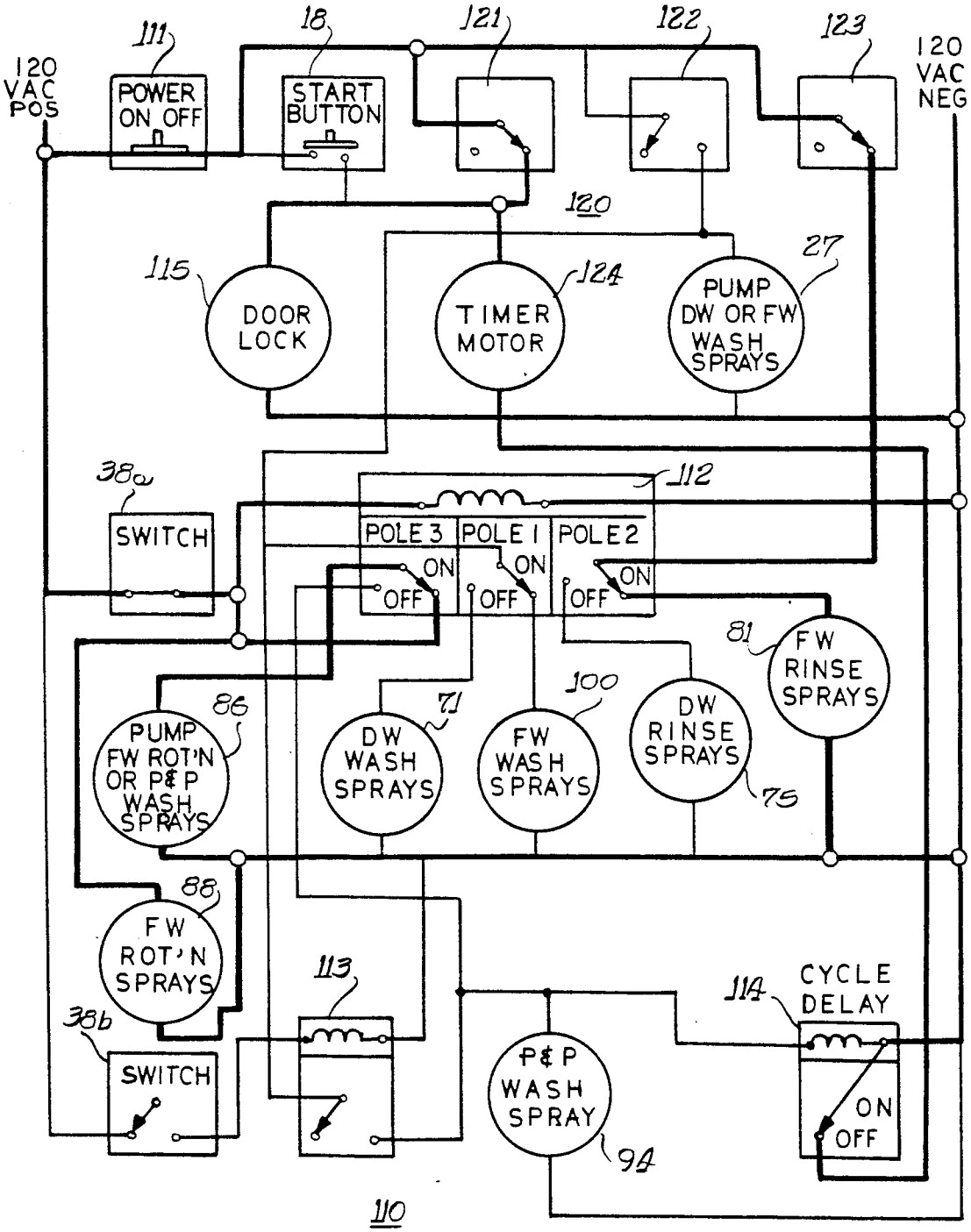
FIG. 10 is a schematic circuit diagram of the electrical circuits of the warewashing machine, illustrating the circuit paths energized during the flatware rinse cycle.
Figure 11:
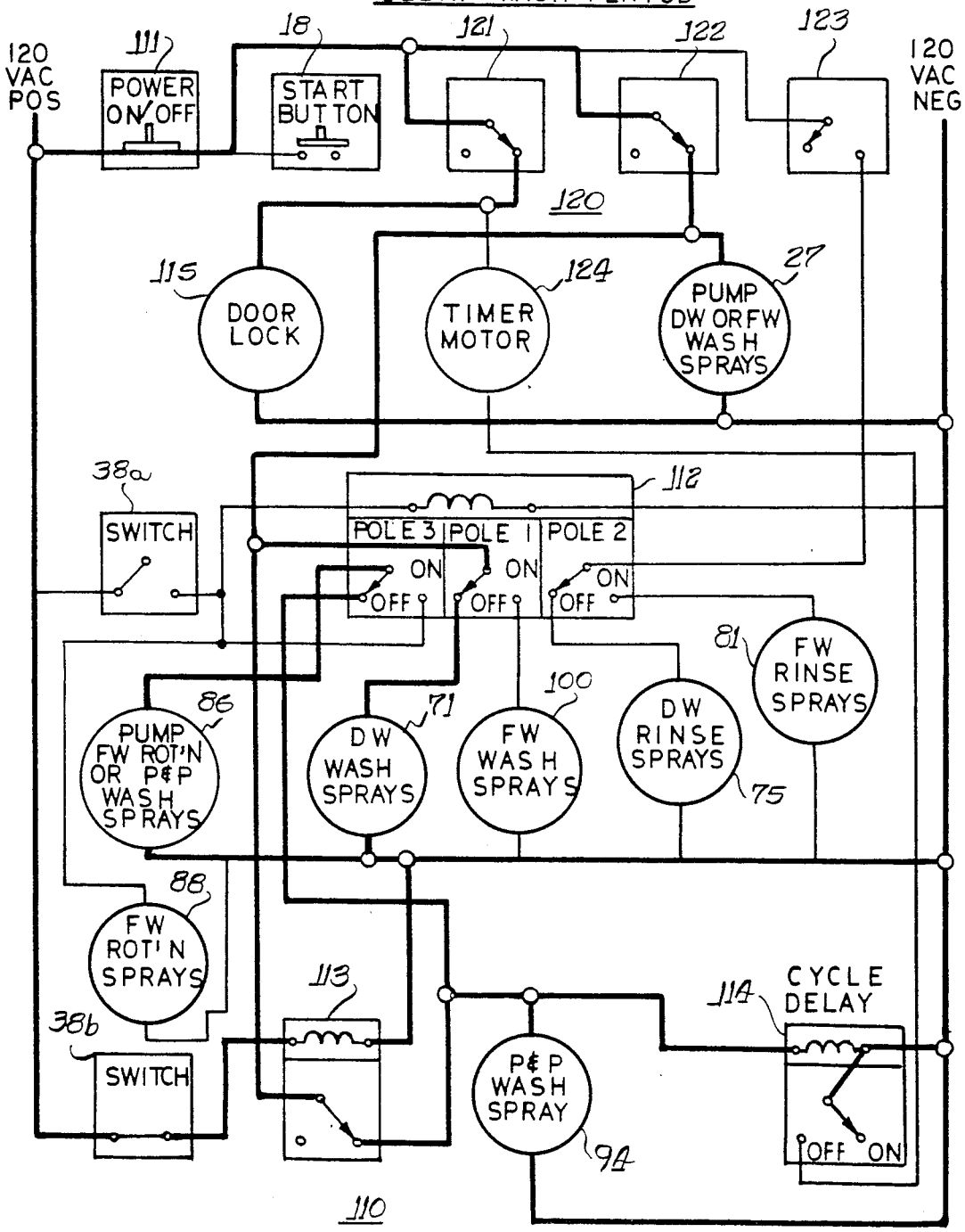
FIG. 11 is a schematic circuit diagram of the electrical circuits of the warewashing machine, illustrating the circuit paths energized during the pot and pan delay wash period.
Figure 12:
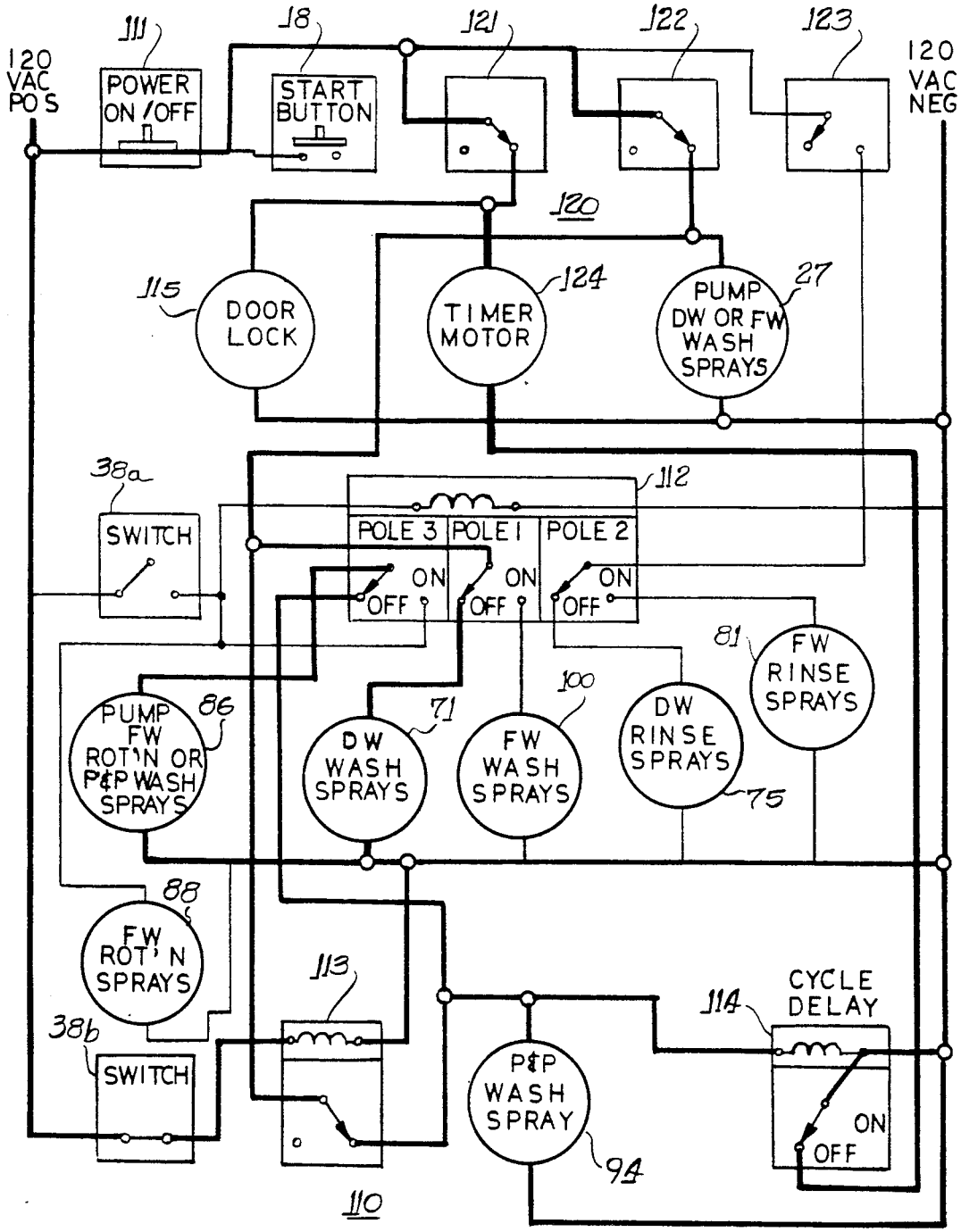
FIG. 12 is a schematic circuit diagram of the electrical circuits of the warewashing machine, illustrating the circuit paths energized during the pot and pan wash cycle.
Figure 13:
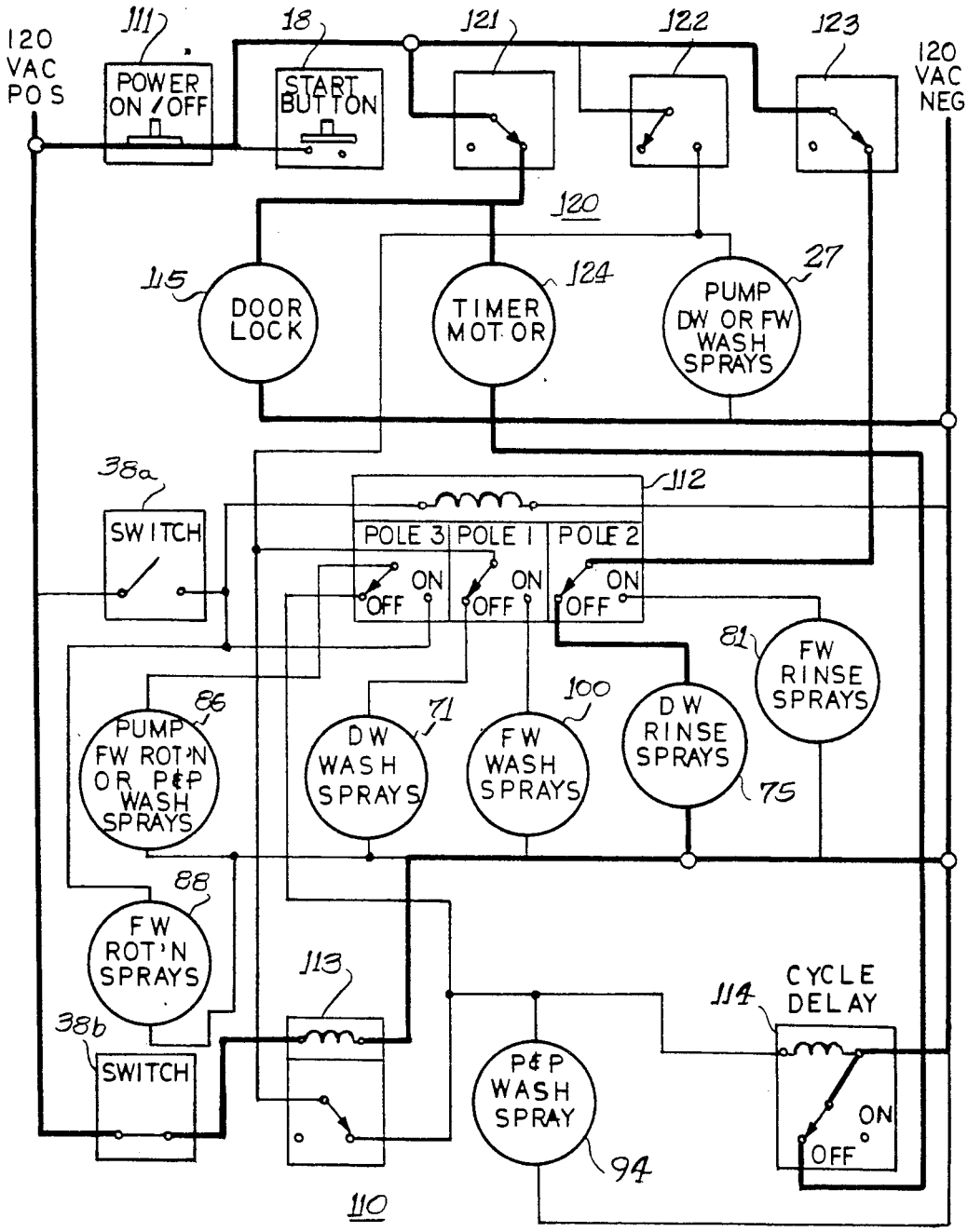
FIG. 13 is a schematic circuit diagram of the electrical circuits of the warewashing machine, illustrating the circuit paths energized during the pot and pa rinse cycle.

Referring now to FIGS. 3, 9 and 10, when a flatware rack 15*a* is positioned within the cleansing chamber 12, the flatware rack anomaly or indicator 35*a* moves lever 36*a* which operates microswitch 38*a*, configuring the warewashing machine 30 for a flatware wash mode, which starts when the start push button 18 is depressed.

During the wash cycle, the recirculating pump 27 is energized through cam switch 122. Also, solenoid valve 100 is energized through cam switch 122 to enable wash fluid to be pumped to the flatware wash nozzle manifolds 76 and 77.

Also, because microswitch 38*a* is operated, relay 112 is operated and the recirculating pump 86 and solenoid valve 88 are energized through contacts of relay 112 to supply water under pressure to the flatware rotation nozzles 84 and 85 and directed to impellers 50 for rotating the baskets 46 and flatware cylinders 47 therein during the wash cycle.

At the end of the wash cycle, cam switch 122 is operated, deenergizing the recirculating pump 27 and solenoid valve 71 and cam switch 123 is operated. Because relay 112 remains operated, recirculating pump 86 and solenoid valve 88 are maintained energized so that water continues to be directed to the impellers 50 to continue rotating the flatware cylinders 47 during the rinse cycle. Solenoid valve 81 is energized through further contacts of relay 112 to supply rinse water from the rinse supply inlet 19 to the flatware rinse nozzle manifolds 78 and 79.

At the end of the flatware rinse cycle, the timer times out which results in deenergization of recirculating pump 86 and solenoid valves 81 and 88.

Referring now to FIGS. 5, 6 and 11–13, when a pot and pan rack 15*b* is positioned within the cleansing chamber 12, the microswitch 38*b* is operated by lever 36*b* which is moved by the anomaly 35*b* on rack 15*b*, configuring the control circuit of the warewashing machine 30 for operation in the pot and pan washer mode. When the start push button is depressed the wash cycle begins. Initially, relay 114 is energized, providing a cycle delay which defines the prewash cycle during which the pot and pan wash cycle is initialized. During this time, solenoid valve 94 and recirculating pump 86 are energized supplying water under pressure to the pot and pan wash nozzle assembly 93 which is located centrally of the aperture 65 in the rack 15*b*, and simultaneously, solenoid valve 71 and recirculating pump 27 are energized supplying water under pressure to the upper and lower dishwashing spray manifolds 21 and 22. At the end of the time period determined by the cycle delay relay 114, the timer motor 124 is energized and the time of a conventional wash cycle ensues as wash water is yet supplied under pressure to pot and pan wash nozzle assembly 93 and upper and lower wash manifolds 21 and 22.

At the end of the wash cycle, cam switch 122 causes recirculating pump 27, solenoid valve 71, the cycle delay relay 114, the solenoid valve 94 and recirculating pump 86 to be deenergized. Also, cam switch 123 energizes solenoid valve 75 to supply rinse water to the upper and lower rinse nozzle manifolds 23 and 24 for the duration of the opt and pan rinse cycle.

What is claimed is:

1. A fluid spray machine for cleansing, rinsing or otherwise treating different types of wares with fluid sprays, comprising: means defining a fluid treatment chamber, a plurality of spray producing means, a plurality of flow control means each associated with a different one of said spray producing means for channeling fluid to the associated spray producing means to produce a fluid spray within said chamber, the fluid sprays produced by different ones of said spray producing means emanating from different points of origin in said chamber, said plurality of flow control means being selectively operable in a plurality of different sets, with each set producing a different spray array within said chamber, and control means for controlling the operation of said flow control means and including select means for enabling different sets of flow control means to produce different spray arrays within said chamber as a function of the type of ware to be cleansed.

2. The fluid spray machine of claim 1, wherein said select means selects the set of flow control means to be enabled automatically in response to inserting a ware containing rack into said fluid treatment chamber.

3. The fluid spray machine of claim 1 for cleansing dishes, flatware and pots and pans, contained in racks, said control means being operable selectively in a dishwashing mode, a flatware washing mode and a pot and pan washing mode, said means for selecting the operating mode comprising a sensor responsive to indicating means carried by said racks.

4. The fluid spray machine of claim 3, wherein the racks include a flatware rack for carrying flatware and a pot and pan rack for carrying pots and pans, said flatware rack and said pot and pan rack each having different indicating means.

5. The fluid spray machine of claim 4, wherein said spray producing means comprises first wash and rinse spray means located in upper and lower portions of said chamber, the associated flow control means channeling fluid thereto when said control means is operating in the dishwashing mode, second wash and rinse spray means located along at least one side of said chamber, the associated flow control means channeling fluid thereto when said control means is operating in the flatware washing mode, and third wash and rinse spray means located in a lower portion of said chamber, the associated flow control means channeling fluid thereto when said control means is operating in the pot and pan washing mode.

6. The fluid spray machine of claim 5 wherein said control means includes cycle timing means for defining wash and rinse cycle times for each operating mode, and timing override means for controlling said cycle timing means to cause the cycle times for at least one of said operating modes to be different from the cycle times for said other operating modes.

7. A warewashing machine for cleansing wares of different types including dishes, flatware and pots and pans which are contained in racks, comprising: means defining a warewashing chamber adapted to receive the ware containing racks, one of said racks including at least one rotatable cylinder holding means for receiving flatware containing cylinders, said machine including means for rotating said cylinder holding means about its individual axis, a plurality of spray producing means selectively operable in sets to produce a plurality of different spray arrays in said warewashing chamber, and control means for controlling the operation of said spray producing means, said control means including select means for selecting different spray arrays as a function of the type of ware to be cleansed.

8. The fluid spray machine of claim 5, wherein said third wash and rinse spray means comprises nozzle means located near the bottom of said chamber, and having slotted orifice means for directing at least one high pressure knife pattern spray of wash fluid upwardly within said fluid treatment chamber.

9. The fluid spray machine of claim 8, wherein said nozzle means comprises a rotating nozzle having a pair of rotating arms of a given length which extend outward radially from said orifice means at diametrically opposed positions with distal end portions defining oppositely directed outlet orifices.

10. The fluid spray machine of claim 8, wherein said pot and pan rack includes an opening in the bottom thereof which is aligned with said nozzle means when said pot and pan rack is located in said fluid treatment chamber.

11. In a system for cleansing, rinsing or otherwise treating different types of wares with fluid sprays, a combination comprising: a fluid spray machine including means defining a fluid treatment chamber, a plurality of spray producing means, a plurality of flow control means each associated with a different one of said spray producing means for channeling fluid to the associated spray producing means to produce a fluid spray within said chamber, the fluid sprays produced by different ones of said spray producing means emanating from different points of origin in said chamber, said plurality of flow control means being selectively operable in a plurality of different sets with each set producing a different spray array within said chamber, sensing means and control means responsive to said sensing means for controlling the operation of said flow control means, and a plurality of ware receiving racks adapted to be inserted into said chamber for introducing wares to be cleansed into said chamber, different ones of said racks receiving different types of wares, at least one of said racks including indicating means, said sensing means responding to said indicating means when said one rack is inserted into said chamber to cause said control means to enable a predetermined set of flow control means whereby the spray array produced is optimum for cleansing wares contained in said one rack.

12. The system of claim 11, wherein said indicating means produces an output which is optically detectable.

13. The system of claim 11, wherein said indicating means produces an output which is magnetically detectable.

14. The system of claim 11, wherein said indicating means produces an output which electronically detectable.

15. The system of claim 11, wherein said one rack is provided with four sides and a bottom and said indicating means is located at a particular location on said one rack so as to operate said sensing means when said one rack is inserted in the chamber.

16. The system of claim 15, wherein said control means includes switch means and wherein said sensing means comprises a mechanical means movable ;by said indicating means to thereby operate said switch means.

17. The system of claim 15, wherein said indicating means is provided at a particular location on at least one of said four sides of said one rack, whereby said indicating means will interface with said sensing means when said one side of said one rack is adjacent to said sensing means.

18. The system of claim 17 wherein one of said indicating means is provided at a particular location on each of said four sides of said one rack, whereby one of said indicating means will interface with said sensing means regardless of which side of said one rack is adjacent to said sensing means.

19. The system of claim 17 wherein one of said indicating means is provided at a particular location on the top surface of each of said sides of said one rack.

20. The system of claim 19, wherein said indicating means comprises a depression in said one side of said one rack.

21. The system of claim 19, wherein said indicating means comprises a variation in the height of said one side of said one rack.

22. The system of claim 19, wherein said indicating means extends the length of at least one side of said one rack.

23. A plurality of work piece holding containers for use with a fluid spray machine which is selectively operable in a plurality of operating modes, each mode being characterized by different fluid spray patterns, the warewashing machine having at least first and second sensing devices spaced apart from one another in a predetermined pattern, and control means responsive to the sensing devices for configuring the fluid spray machine for operation in a given one of its operating modes, said plurality of work piece holding containers being of equal size, each of said containers being designed to hold differing types of work pieces in differing orientations, each of said containers being adapted to be received in a fluid treatment chamber of the fluid spray machine for introducing work pieces into the chamber for treatment, each container having a plurality of side walls and including indicating means associated with an outer surface of at least one of said side walls and in a specific location unique to the type of work pieces to be contained therein, the indicating means associated with a first one of said containers being located at a position along said one side wall is spaced-apart from the position of the indicating means associated with a side wall of a second one of said containers in the same predetermined pattern as the first and second sensing devices, whereby said one container, upon being located in a given singular fixed position within the chamber, shall have its indicating means located so as to consistently interface with only the first sensing device, and said second container, upon being located in said given singular fixed position within the chamber, shall have its indicating means located so as to consistently interface with only the second sensing device.

24. The containers of claim 23, wherein said indicating means produces an output which is optically detectable.

25. The containers of claim 23, wherein said indicating means produces an output which is magnetically detectable.

26. The containers of claim 23, wherein said indicating means produces an output which is electronically detectable.

27. The containers of claim 23 having four sides and a bottom, said indicating means being provided at a particular location on at lest one of said sides.

28. The containers of claim 23, wherein one of said indicating means is provided at a particular location on each of said four sides.

29. The containers of claim 23, wherein one of said indicating means is provided at a particular location on the top surface of each of said sides.

* * * * *